United States Patent [19]

Mackintosh

[11] 4,000,702

[45] Jan. 4, 1977

[54] TRANSPORTATION SYSTEM

[76] Inventor: Charles Mackintosh, 3838 Oakwood Ave., Los Angeles, Calif. 90004

[22] Filed: July 24, 1975

[21] Appl. No.: 598,875

[52] U.S. Cl. ..... 104/244; 104/89; 104/107; 104/118; 105/141; 105/148

[51] Int. Cl.[2] ..... B61B 12/02

[58] Field of Search ..... 104/244, 242, 121, 120, 104/119, 118, 112, 110, 106, 95, 89, 1 A, 107; 105/141, 146, 147, 148, 168, 144, 145; 280/87 B, 112 A; 295/1

[56] References Cited

UNITED STATES PATENTS

| | | | |
|---|---|---|---|
| 1,529,101 | 3/1925 | Wiesinger | 104/244 |
| 2,623,475 | 12/1952 | Fraser | 104/95 |
| 3,122,105 | 2/1964 | Scherer | 104/121 X |
| 3,194,179 | 7/1965 | Scherer | 104/121 |
| 3,244,113 | 4/1966 | Smyser | 104/112 |
| 3,679,017 | 7/1972 | Roe | 280/112 A X |
| 3,774,547 | 11/1973 | Widiger et al. | 104/244 |
| 3,890,904 | 6/1975 | Edwards | 104/121 |

*Primary Examiner*—Robert J. Spar
*Assistant Examiner*—Randolph A. Reese
*Attorney, Agent, or Firm*—Watson, Cole, Grindle & Watson

[57] ABSTRACT

A transportation system includes a pair of rails spaced transversely of an elongated track on which flanged support wheels of a vehicle are adapted for travel along the sides, top or bottom of the track. The support wheels are transversely spaced apart by at least one-half the width or one-half the height of the vehicle and are sloped to respectively lie in planes intersecting at the center of gravity of the vehicle. Accordingly, horizontal forces acting on the vehicle during travel around curves produce no stresses on the wheel flanges but increase direct stress on one set of wheels and decrease direct stress on the other set of wheels.

In another embodiment, the wheels are designed to tip parallel to the resultant forces acting on the wheels during horizontal force changes acting on the vehicle. Such is effected by the provision of curved bearing surfaces associated with the rails and mounted on the wheel mounts in such a manner that the thrusts of the car supports acting on the bearing elements intersect below the wheel bearing surfaces of the rails.

20 Claims, 12 Drawing Figures

21
86
45
27
5
5
7
7
33
76
74
27a
29
46
42
75
44
27b 75
77
21
86
77
42

42
75
77
21
77
76
87
87
6
6
26a
39
75
26
41
26b
28
74
77
73
23
38
37
77
76

TRANSPORTATION SYSTEM

BACKGROUND OF THE INVENTION

This invention relates generally to a rail system wherein the cars may be supported above, below or to either side of a track, and more particularly to such a system wherein stresses on the wheel flanges are substantially avoided during changes in horizontal loads acting on the car.

In U.S. Pat. Nos. 3,122,105 and 3,194,179 issued to Lester G. Scherer monorail systems are disclosed wherein track beams generally I-shaped in cross-section are used for support of the travelling cars having lower wheels sloping inwardly toward the car and upper wheels disposed horizontally. In both systems the lower wheels rotate about axes perpendicular to the resultant of forces exerted by the lower wheels on its rail. Also, the lower wheels of both systems lie in respective planes which are parallel to such resultant forces although such planes do not intersect at the center of gravity of the car. Instead, the planes in which the lower wheels lie in both monorail systems intersect with vertical planes containing the centers of gravity of both cars, such intersections being located upwardly of the centers of gravity themselves. Accordingly, the horizontal force changes acting on the rails as the car travels around curves and as a result of horizontal wind loads will create an unstable condition for the cars and possibly a derailment of the lower wheels. Therefore, in the monorail system shown in FIG. 8 of U.S. Pat. No. 3,122,105, the bottom wheels are quite likely to disengage from the concave lower rail with the car swinging outwardly of the track as the curve is negotiated thereby resulting in all of the load being applied vertically on the upper horizontal wheels so as to effect a dangerous condition and even collapse of the car. Also, the horizontal stresses in the monorail system of U.S. Pat. No. 3,194,179, while the car is negotiating a curve, must be resisted by flanges of the sloping lower wheels by a wedging action only. In such a prior art arrangement as well as in the standard railway car system, the horizontal forces occurring as the car moves along a curve in the track must be resisted by a single flange of one of the spaced apart wheels and by a single rail. Accordingly, the wheels must be sufficiently strong to resist the entire horizontal cornering loads in both directions respectively applied at single points on the outer rims. The axles of the standard railway car systems must therefore be likewise sufficiently strong in order to take up the vertical bending loads in one direction and take up the horizontal loads in another direction applied to the flange of the wheel. And, the tolerances required between the flanges of the wheels create a condition where even without any horizontal loads the cars exhibit a weaving behavior during travel.

Moreover, in the later Scherer patent of those mentioned, the upper wheels are mounted on the car through a pivot pin to compensate for changes and elevation of the car when loaded. The pivot axis is, however, located above the upper wheels so as quite possibly cause the upper wheels to swing upwardly about this pivot axis thereby causing collapse of the car. And, springs 144 are provided in this patent for adjusting the axis of rotation of the lower wheels so as to remain perpendicular to the resultant forces of the car directed toward the lower rail. The lower wheels nevertheless remain parallel to the resulting forces as in the manner discussed above.

SUMMARY OF THE INVENTION

It is therefore an object of the present invention to avoid the various drawbacks of the prior art by providing a transportation system wherein the major lateral forces acting on the rails, as during travel of the car along a curve, will produce only an increase in direct stress on one set of wheels and a decrease of direct stress on the other set of wheels thereby substantially avoiding any stresses on the wheel flanges, rendering the system more stable, and permitting the wheels and axles to be of a lighter and more economical design.

Another object of this invention is to provide such a system wherein transversely spaced wheels are mounted along one of a side, top or bottom surface of a car, the wheels respectively engaging spaced rails mounted on a track beam and lying in planes intersecting at the center of gravity of the car, and the wheels being spaced apart a distance of at least one-half the width or one-half the height of the car corresponding to the particular surface on which they are mounted.

A further object of the invention is to provide such transportation system wherein the track comprises a rectangular box beam, and the rails are circular in cross-section with the rail engaging surfaces of the wheels being correspondingly shaped.

A still further object is to provide such a system wherein means are provided to facilitate tipping of the wheels into parallelism with the resultant forces acting on the rails and to maintain the wheels in planes intersecting with the center of gravity of the car in response to changes in horizontal forces acting on the rails.

A still further object of the invention is to provide such a system wherein tipping of the wheels is effected by means of convex bearing element supported by the wheel mounts and against which support members of the car bear so as to permit the wheels to tip relative to the rails without the substantial use of springs, the thrusts on the bearing elements from the car support members lying in planes intersecting below the center of radius of the rails.

Other objects, advantages and novel features of the invention will become more apparent from the following detailed description of the invention when taken in conjunction with the accompanying drawings.

DESCRIPTION OF THE PREFERRED EMBODIMENT

Figure 1:
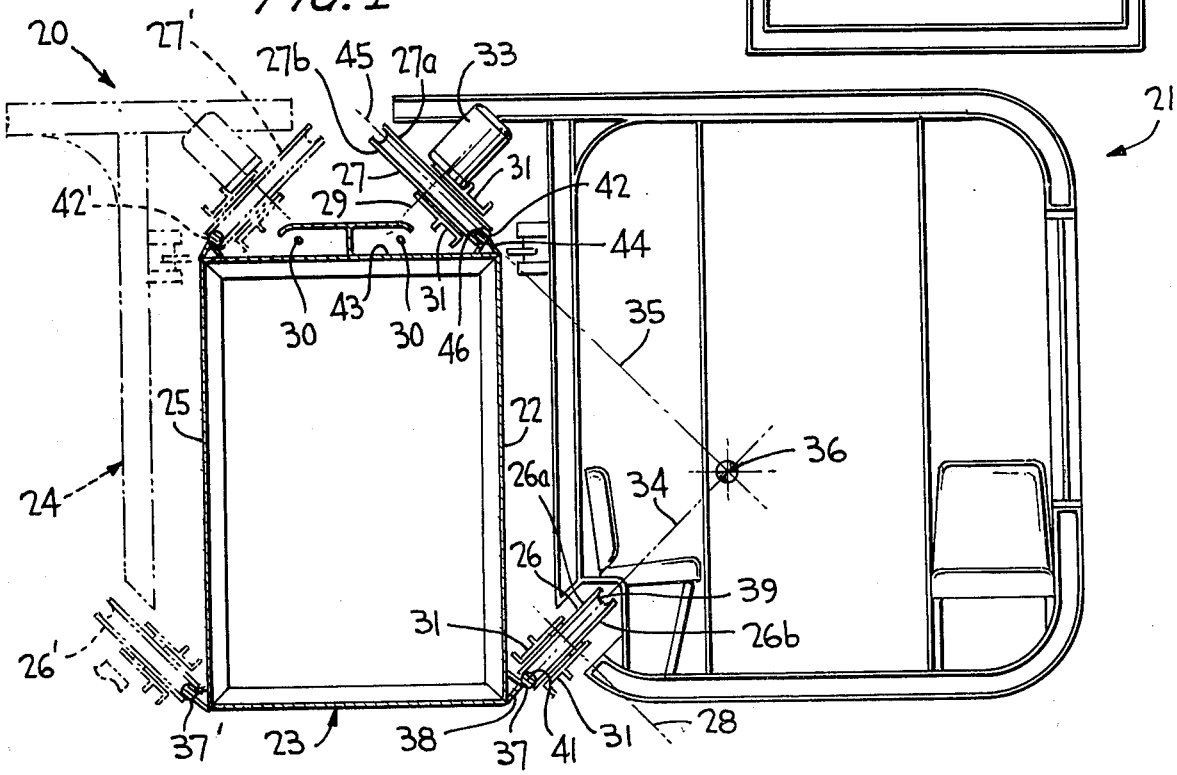

Turning now to the drawings wherein like reference characters refer to like and corresponding parts throughout the several views, a transportation system in accordance with the invention is shown in FIG. 1 and is generally designated 20. Elements of the system not needed to facilitate description thereof are omitted for the sake of clarity. The system generally includes an elongated car 21 mounted for linear movement along a side 22 of an elongated hollow rectangular box beam generally designated 23. Another car 24 is shown in part and in phantom outline mounted for linear movement along an opposite side 25 of the box beam. A lower set of wheels 26 and an upper set of wheels 27 are mounted on car 21 for rotation about their respective axes 28 and 29. It should be understood that lower wheels 26 and upper wheels 27 are respectively mounted in pairs along the car in any normal manner as by means of wheel mounts 31 and 32. Power driving means such as an electric motor 33 is operatively connected to the shaft of one of the wheels such as upper wheel 27 for rotating same so as to drive the car along the beam. In accordance with an important feature of the invention, the lower wheels lie in a single plane 34 and the upper wheels lie in a single plane 35 which planes are made to intersect together at the center of gravity 36 of car 21.

A lower rail 37 generally of circular cross-section is mounted on side 22 of the box beam near the lower end thereof by means of a plurality of V-irons 38 welded or otherwise connected to the box beam. Lower wheels 26 have rail engaging surfaces 39 generally complementary to the cross-sectional shape of rail 37 and in engagement with a wheel engaging surface 41 thereof. Similarly, an upper elongated rail 46 generally circular in cross-section is mounted on a top surface 43 of the box beam near an end thereof adjacent side surface 22. This rail is welded or otherwise secured to a plurality of V-irons 44 which are similarly welded or otherwise connected to surface 43, and rail engaging surfaces 45 of the upper wheels are generally complementary in shape to the cross-sectional shape of rail 42 for engagement along a wheel engaging surface 46 of the upper rail.

Figures 4, 5, 6:
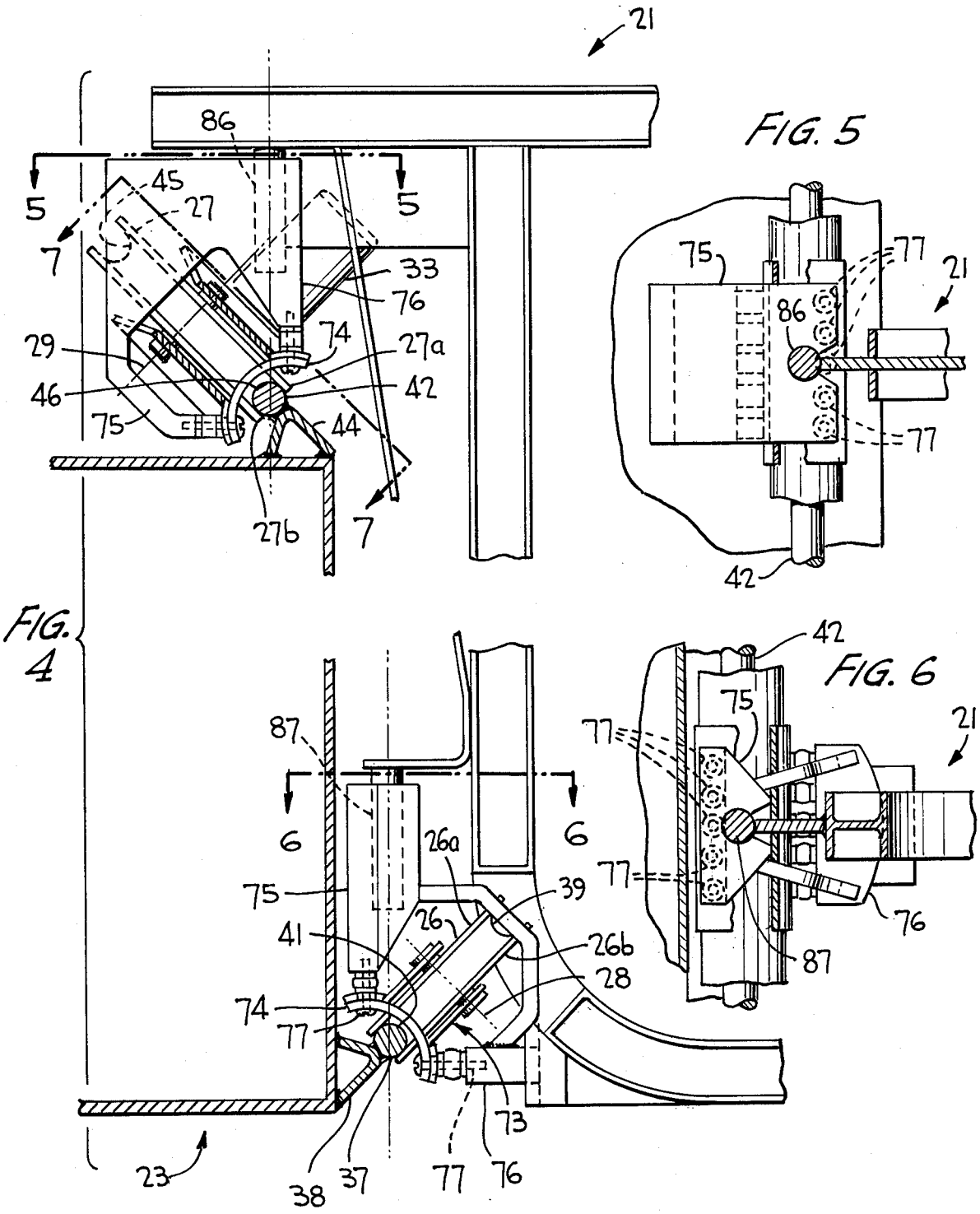
FIG. 4 is an elevational view showing the FIG. 1 embodiment in slightly more detail.
FIGS. 5 and 6 are sectional views taken substantially along lines 5—5 and 6—6 of FIG. 4, respectively.

The details of the above-described elements are more clearly shown in FIG. 4, and it should be noted that the upper and lower wheels are mounted in place so as to be spaced apart a distance of at least one-half the height of car 21.

By reason of the upper and lower wheels respectively lying in planes intersecting at the center of gravity 36 of car 21, horizontal forces acting on the upper and lower rails will produce no stresses on flanges 26*a*, 26*b* and 27*a*, 27*b* of the lower and upper wheels as the car is moving along a curve. The resultant of the vertical load and the horizontal force acting through center of gravity 36 away from beam 23 and extended by rail 42 against upper wheels 27, lies in plane 35 so as to effect direct stresses on the upper wheels. Similarly, the resultant of the vertical load and the horizontal force acting through center of gravity 36 toward beam 23 and exerted by rail 37 against lower wheels 26, lies in plane 34 so as to effect direct stresses on the lower wheels. Therefore, with such an arrangement, these direct stresses on one set of wheels are increased and the direct stresses on the other set of wheels are decreased depending on whether the horizontal loads are acting in a direction away from or toward beam 23. The wheels may therefore be of reduced weight and their axles may likewise be of lesser weight. Also, it should be pointed out that other horizontal stresses acting on the flanges of the wheels, such as those caused by wind forces and changes in the center of gravity from loading, are produced only by forces not intersecting at the center of gravity 36 of the car. These forces are relatively small since they lie not far from center of gravity 36.

It can be seen in FIG. 1 that box beam 23 is symmetrical about its vertical axis and that upper and lower rails 37' and 42' are respectively secured in place along top surface 43 and side surface 25 of the box beam similarly as described for rails 42 and 37. Moreover, upper and lower wheels 27' and 26' are mounted on car 24 and lie in respective planes intersecting at the center of gravity of car 24. This car 24 is identical in all respects to car 21 as afore-described except that car 24 is designed for linear movement along opposite side 25 of the box beam.

Figure 2:
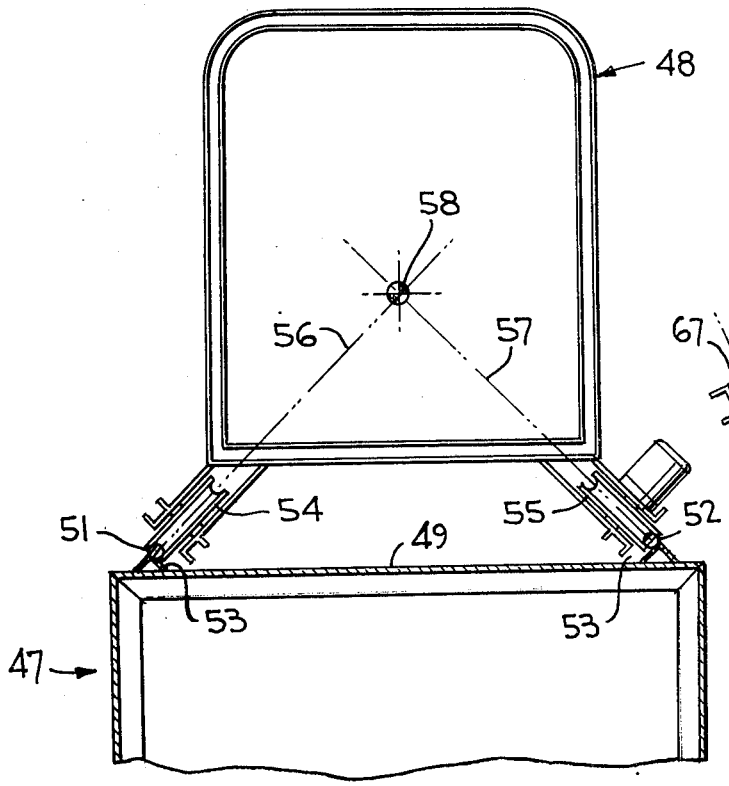
FIGS. 1, 2 and 3 are end elevational views in general outline showing three embodiments of the present invention wherein the car is mounted to one side, at the top and along the bottom of a box beam, respectively.

Another embodiment of the transportation system in accordance with this invention is shown in FIG. 2 as including a hollow elongated box beam 47 supporting a car 48 for movement along top surface 39 of this box beam. Transversely spaced elongated rails 51 and 52, generally circular in cross-section, are welded or are otherwise connected to V-irons 53 which are themselves welded or otherwise secured along top surface 49 similarly as that described with reference to FIG. 1. Wheels 54 and 55 are mounted on car 48 in an identical manner as that described for the FIG. 1 embodiment, these wheels being spaced apart by at least a distance of one-half the width of the car. Also, wheels 54 and 55 respectively lie in planes 56 and 57 which intersect at the center of gravity 58 of the car.

Figure 3:
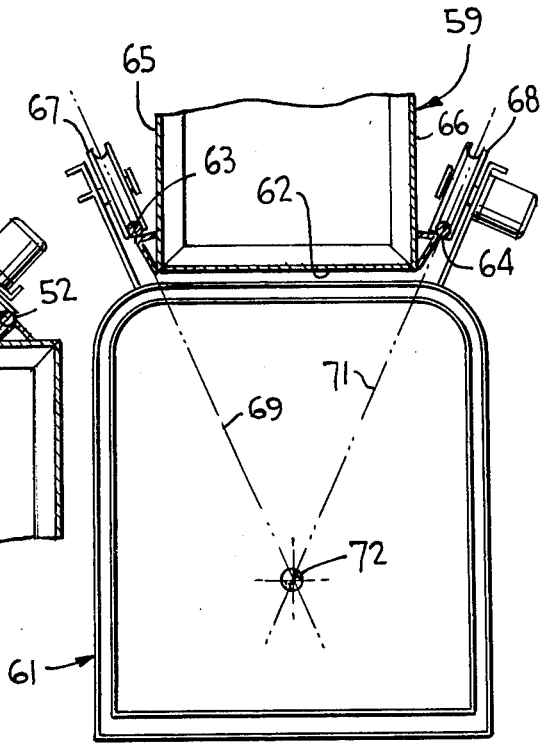

With reference to FIG. 3, a further embodiment of the present transportation system is shown as including a hollow elongated box beam 59 and a car 61 suspended on the box beam for linear movement along bottom surface 62 of beam 59. Rails 63 and 64, generally circular in cross-section, are respectively mounted on opposite sides 65 and 66 of this box beam. The rails are mounted in place in a manner similar to that described for rails 37 and 42 of the FIG. 1 embodiment, and wheels 67 and 68 are respectively mounted on car 61 similarly as that described for the FIG. 1 embodiment. These wheels are in rolling engagement with their respective rails 63 and 64 and are spaced apart a distance of at least one-half the width of car 61. And, wheels 67 and 68 respectively lie in planes 69 and 71 which intersect at the center of gravity 72 of car 61. Accordingly, the respective resultants of the oppositely acting horizontal forces and the vertical load exerted on the wheels in both the FIG. 2 and FIG. 3 embodiments, as when cars 48 and 61 are respectively negotiating turns in the track, respectively lie directly along planes 56 and 57 and along planes 69 and 71 so as to produce only direct stresses on the wheels of the cars similarly as described with reference to the FIG. 1 embodiment. And, depending on the turning directions of the cars while negotiating their turns, these direct stresses will be reduced for one set of wheels and increased for the other set of wheels of these cars.

It should be also pointed out that box beams 23, 47 and 59 of the FIGS. 1 to 3 embodiments may be supported on the ground in any normal manner, as by means of spaced support standards, without departing from the scope of the present invention.

In order to compensate fully for those horizontal forces as mentioned above, such as wind forces and changes in the center of gravity from loading which forces do not meet at the center of gravity of the car, a further embodiment of the invention is shown in FIG. 4 wherein such an arrangement permits the wheels to tip so as to assure that the upper and lower wheels will remain substantially within planes intersecting at the center of gravity of the car. Moreover, such an arrangement is applicable for any transportation system wherein the wheels rotate about an axis parallel to the transverse axis of the car (as in FIG. 12) in which the wheels are made to tip so as to lie in respective planes intersecting with the center of gravity of the car depending on their direction of horizontal force while the car is negotiating a curve. For the standard railway shown in FIG. 12, the wheels will tip to the left in response to a horizontal force directed toward the right at the center of gravity of the car proceeding about a curve. In such an arrangement the right wheels shown in this FIGURE will tip so as that the resultant force acting at the center of gravity will bear directly on the right wheels with no consequent stresses on the flanges of those right wheels similarly as in the manner discussed for the FIGS. 1–3 embodiments. The converse is true for the left wheels when the horizontal force acting through the cars center of gravity is directed to the left.

Figure 7:
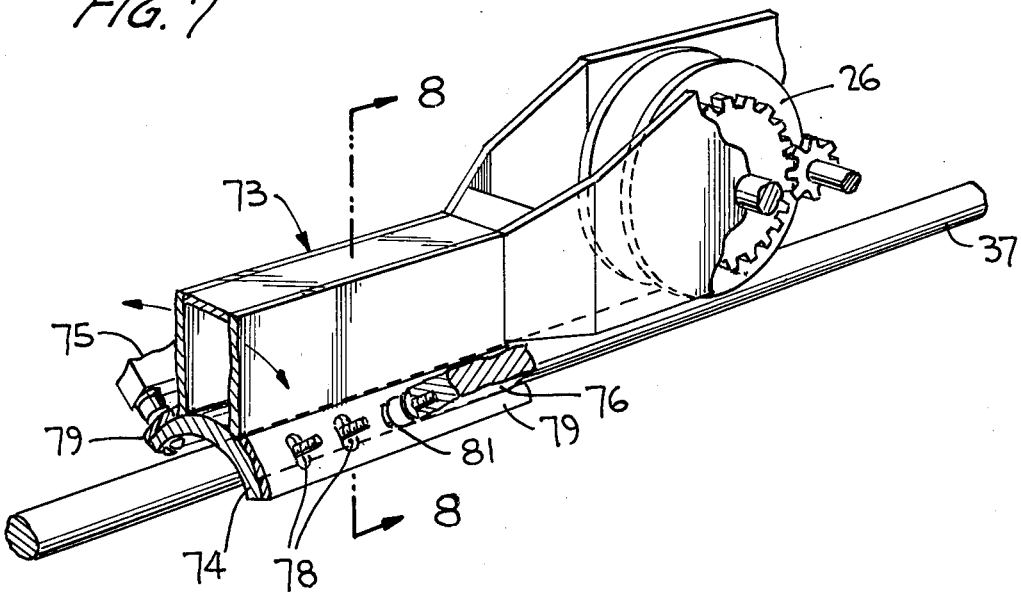
FIG. 7 is a perspective view showing a part of the car wheels relative to a rail together with the wheel mount and bearing a element arrangement, taken along line 7—7 of FIG. 4.

In each of the embodiments according to this invention, the wheels are typically mounted together in pairs. More specifically, FIG. 7 shows wheels so arranged for the FIGS. 4 to 8 embodiment. Wheels 26 are coupled together (only one of which being shown for clarity) by means of a wheel housing 73.

Turning now to FIGS. 4–8 it can be seen that a tip of wheels 26 are coupled together (only one of which being shown in FIG. 7 for clarity) by means of a wheel housing 73. A convex bearing element 74 is supported by the housing between the pair of wheels and overlies rail 37. The bearing element is fixedly connected to the wheel mount as by welding or the like, and support members 75 and 76 of the car are connected to the bearing element along opposite sides thereof so as to support the car on opposite wheel mounts of the transversely spaced wheels. These support members are connected to the bearing elements by means of threaded fasteners 77 extending through transversely elongated slots 78 formed in the bearing element. Anti-friction shoes 79 of Teflon or the like are bonded onto the outer surface of the bearing element beneath the car support members, and similar type anti-friction elements 81 surround the shanks of the fasteners in sliding engagement with shoes 79. Also, elastomeric bearing pads 82 surround the fastener shanks to provide some cushioning effect for the car.

Figure 8:
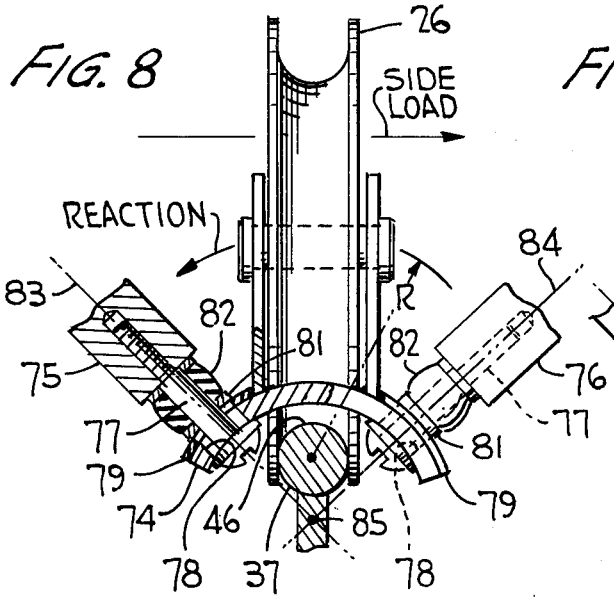
FIG. 8 is a sectional view taken substantially along line 8—8 of FIG. 7.

As can be seen in FIG. 8, support members 75 and 76 lie in respective planes 83 and 84 which intersect along a line 85 located below the wheel engaging surface 46 of the rail. In other words, the radius of curvature of the bearing element is greater than the radius of curvature of the rail. Accordingly, a horizontal side load acting at the center of gravity of the car, as for example toward the right shown in FIG. 8, causes the wheels to react by tipping to the left. Wheels 26 are accordingly tipped so as to lie in a plane intersecting with the center of gravity of the car.

Figure 12:
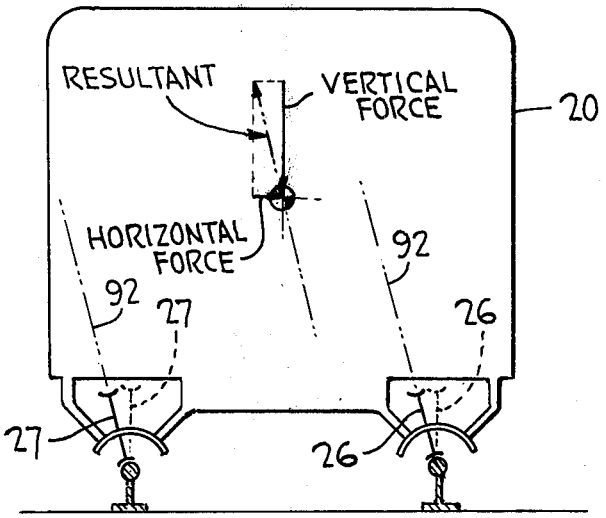
FIG. 12 is an end elevational view of a standard car arrangement adapted in accordance with the present invention.

Also wheels 26 and 27 of a standard car arrangement as in FIG. 12 will tip to the left in response to a horizontal force directed to the right through the center of gravity of the car so that the resultant of forces through the center of gravity will be exerted directly on wheels 26 and 27 thereby increasing the resultant load on these wheels during movement of the car about a curve as the wheels tip to planes such as 92 parallel to the resultant load on the individual wheels. The wheels are permitted to tip as afore-described by reason of the arrangement wherein planes 83 and 84 along which the thrusts of the support members act intersect below the wheel bearing surface 46 of the rail.

Also, as can be seen in FIGS. 4 to 6 in the drawings, car 21 is supported on the rails of box beam 23 in such a manner as to assure its stability when moving linearly along the box beam. Accordingly, pins 86 and 87 extend outwardly from portions of the car and are seated within the upper and lower support members 75. The vertical axes of these pins respectively intersect the central axes of rails 42 and 37.

Figure 9:
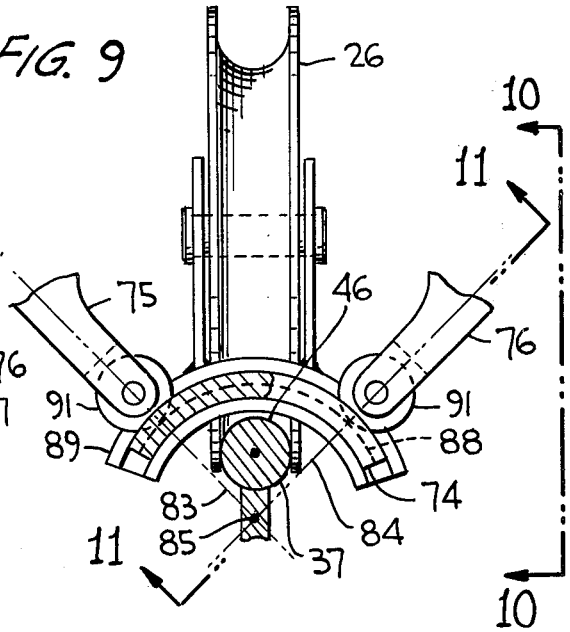
FIG. 9 is a sectional view similar to FIG. 8 but showing another embodiment of an arrangement permitting tipping of the wheels relative to the rails.
Figure 10:
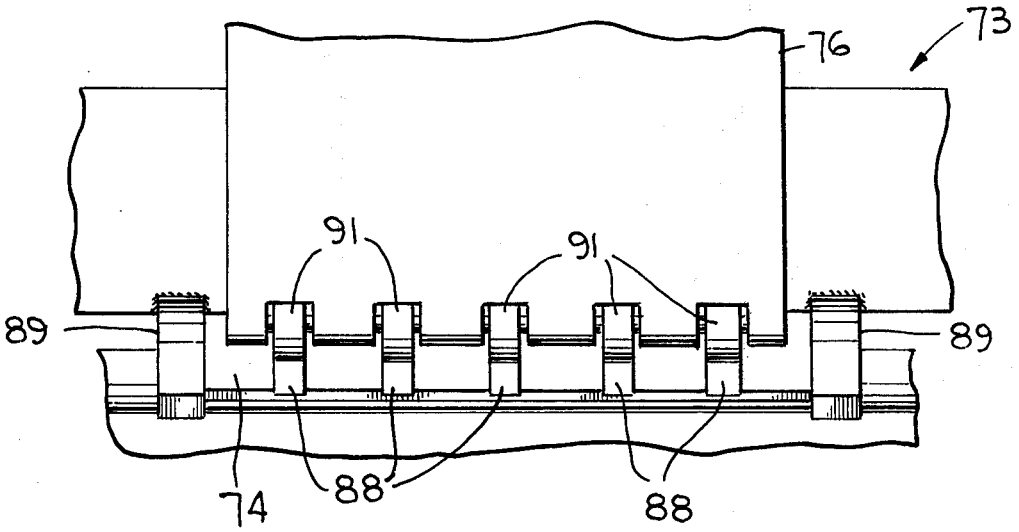
FIG. 10 is a side elevational view of the FIG. 9 embodiment looking along line 10—10 of that FIGURE.
Figure 11:
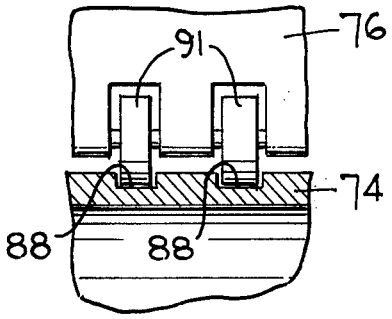
FIG. 11 is a sectional view taken substantially along line 11—11 of FIG. 9.

As a variation of the FIG. 8 embodiment, bearing element 74 is provided with a plurality of transverse grooves 88 on the top surface thereof, and the bearing element is connected to housing 73 by means of spaced support hangers 89 as in the manner as shown in FIG. 10. These support hangers are fixedly secured to the wheel housing fore and aft of the bearing element and are connected to opposite ends of the bearing element in any normal manner. And, in lieu of cooperating anti-friction surfaces as in FIG. 8, rollers 91 are rotatably mounted on the free ends of the support members 75 and 76 for rolling contact within grooves 88. Accordingly, wheels 26 in the FIG. 9 embodiment are capable of tipping to the left in response to a horizontal load directed to the right similarly as in the manner described for FIG. 8. The details of the rolling engagement between rollers 91 and grooves 88 are shown in FIG. 11.

From the foregoing it can be seen that a transportation system has been devised for cars moving linearly along a surface of a track such as a box beam, the wheels of the car being spaced apart a distance of at least one-half the width or one-half the height of such car and lie in planes intersecting at the center of gravity of the car as in FIGS. 1–3. Also, such angularly related wheels may be designed to tip in response to changes in vertical loading and horizontal forces from wind or the like not acting through the center of gravity, so that the wheels will substantially remain in planes intersecting with the center of gravity of the car. Such arrangement is also made possible for standard railway car arrangements.

Obviously, many modifications and variations of the invention are made possible in the light of the above teachings. It is therefore to be understood that within the scope of the appended claims the invention may be practiced otherwise than as specifically described.

What is claimed is:

1. In a transportation system, comprising:

an elongated track having a pair of rails mounted thereon, said rails being spaced apart transversely of said track, in combination with an elongated car adapted for travel along said track, first and second wheel means mounted along a side of said car and respectively engaging said rails, said first and second wheel means including a plurality of first and second wheels respectively lying in planes intersecting at the center of gravity of said car, said first and second wheel means being spaced apart a distance of at least one-half said side of said car, said wheels of said respective wheel means thereby being parallel to the resultants of force acting on said rails while said car travels along other than straight paths, whereby direct stresses on said wheels of one of said wheel means increases while direct stresses on said wheels of the other of said wheel means decreases during travel of said car along other than straight paths.

2. In the system according to claim 1, wherein said track has an upper surface on which one of said rails is mounted, said wheels of said first wheel means engaging said one rail along a bearing surface thereof facing directly away from the center of gravity of said car, and said track having a side surface on which the other of said rails is mounted, said wheels of said second wheel means engaging said other rail along a bearing surface of said other rail facing directly toward the center of gravity of said car.

3. In the system according to claim 1, wherein said track has an upper surface on which both of said rails are mounted, said wheel bearing surfaces of both said rails facing directly toward the center of gravity of said car.

4. In the system according to claim 1, wherein said track has opposing side surfaces on which said rails are respectively mounted, said wheel bearing surfaces of both said rails facing directly toward the center of gravity of said car.

5. In the system according to claim 1, wherein said wheel means include wheel mounts fixedly supporting convex bearing elements located adjacent said bearing surfaces of said rails, said car having transversely spaced support members on which said bearing elements are mounted for arcuate shifting movements of said wheel means about said rails in response to horizontal force changes acting on said wheel means, said support members thrusting against said bearing elements along planes intersecting below said bearing surfaces of said rails.

6. In the system according to claim 5, wherein said rails are of circular cross-section.

7. In the system according to claim 5, wherein anti-friction means are provided between said support members and said bearing elements.

8. In the system according to claim 7, wherein said bearing elements are mounted in place by means of fasteners extending through transversely elongated slots located in said bearing elements, said anti-friction means comprising cooperating anti-friction wear plates on said bearing elements and said support members.

9. In the system according to claim 8, wherein elastomeric bearing pads are disposed between said support members and said wear plates.

10. In the system according to claim 7, wherein said anti-friction means comprise rollers on said support members in rolling engagement with said bearing elements along grooves located transversely along said bearing elements.

11. In a transportation system comprising an elongated track having a pair of rails mounted thereon, said rails being circular in cross-section and spaced apart transversely of said track, in combination with a car adapted for travel along said track, first and second wheel means mounted along a side of said car, said wheel means including wheels having surfaces complementary in shape and in rolling engagement with said rails, said first and second wheel means being spaced apart a distance of at least half said side of said car and further including wheel mounts fixedly supporting convex bearing elements located adjacent said rails, said car having transversely spaced support members on which said bearing elements are mounted for arcuate shifting movements of said wheel means about the central axes of said rails in response to horizontal force changes acting on said wheel means, said support members thrusting against said bearing elements along planes intersecting below said central axes of said rails, whereby horizontal stresses exerted on said wheel means during travel of said car are substantially reduced.

12. In the system according to claim 11, wherein anti-friction means are provided between said support members and said bearing elements, said anti-friction means comprising cooperating anti-friction wear plates on said bearing elements and said support members, said bearing elements being mounted in place by means of fasteners extending through transversely elongated slots located in said bearing elements.

13. In the system according to claim 12, wherein elastomeric bearing pads are disposed between said support members and said wear plates.

14. In the system according to claim 11, wherein anti-friction means are provided between said support members and said bearing elements, said anti-friction means comprise rollers on said support members in rolling engagement with said bearing elements.

15. In a transportation system comprising: a track in the form of a rectangular box beam, first and second rails of circular cross-section mounted respectively on the top surface and on a side surface of said beam, in combination with an elongated car adapted for travel along said track, first and second wheel means including a plurality of wheels mounted on said car in rolling engagement respectively with said first and second rails, said wheels of said first and second wheel means lying in respective planes intersecting with the center of gravity of said car, and said first and second wheel means being spaced apart a distance of at least one-half the height of said car, whereby horizontal stresses exerted on said wheel means during travel of said car are substantially reduced.

16. In the system according to claim 15, wherein motor drive means are operatively connected to one of said wheel means for driving said car along said rails.

17. In a transportation system, comprising: a track in the form of a rectangular box beam, a pair of transversely spaced rails of circular cross-section mounted on the top surface of said beam, in combination with an elongated car adapted for travel along said track, first and second wheel means including a plurality of wheels mounted on said car and having surfaces complementary to and in rolling engagement respectively with said rails, said wheels of said first and second wheel means lying in respective planes intersecting with the center of gravity of said car, and said first and second wheel means being spaced apart a distance of at least one-half the width of said car, whereby horizontal stresses exerted on said wheel means during travel of said car are substantially reduced.

18. In the system according to claim 17, wherein motor drive means are operatively connected to one of said wheel means for driving said car along said rails.

19. In a transportation system, comprising: a track in the form of a rectangular box beam, first and second rails of circular cross-section mounted respectively on opposite sides of said beam, in combination with an elongated car adapted for travel along said track, first and second wheel means including a plurality of wheels mounted on said car and having surfaces complementary to and in rolling engagement respectively with said rails, said wheels of said first and second wheel means lying in respective planes intersecting at the center of gravity of said car, and said first and second wheel means being spaced apart a distance of at least one-half the width of said car, whereby horizontal stresses exerted on said wheel means during travel of said car are substantially reduced.

20. In the system according to claim 19, wherein motor drive means are operatively connected to one of said wheel means for driving said car along said rails.

* * * * *